US006554702B2

(12) United States Patent
Mahar et al.

(10) Patent No.: US 6,554,702 B2
(45) Date of Patent: Apr. 29, 2003

(54) CARD GAME AND METHOD THEREOF FOR PLAYING A REAL TIME CARD GAME

(76) Inventors: Shaun Mahar, 64-34 102nd St., Apt. 1J, Rego Park, NY (US) 11374; Greggory Schwartz, 144-29 70th Ave., Flushing, NY (US) 11367; Raffi Tasci, 84-28 Doran Ave., Glendale, NY (US) 11385-7732

( * ) Notice: Subject to any disclaimer, the term of this patent is extended or adjusted under 35 U.S.C. 154(b) by 75 days.

(21) Appl. No.: 09/827,088

(22) Filed: Apr. 5, 2001

(65) Prior Publication Data

US 2002/0147039 A1 Oct. 10, 2002

(51) Int. Cl.[7] ..... G06F 19/00; A63F 1/00
(52) U.S. Cl. ..... 463/11; 273/292; 273/308
(58) Field of Search ..... 273/292, 308, 273/263, 284; 463/11, 23

(56) References Cited

U.S. PATENT DOCUMENTS 1,322,954 A * 11/1919 Rosenfeld ..... 273/298
1,640,261 A * 8/1927 Whaley et al. ..... 273/298
4,415,160 A * 11/1983 Lamb ..... 273/243
4,861,031 A * 8/1989 Simms ..... 273/295
5,163,688 A * 11/1992 Simms ..... 273/298
5,193,818 A * 3/1993 Leeson ..... 273/308
5,435,568 A * 7/1995 Black ..... 273/303
5,662,332 A * 9/1997 Garfield ..... 273/308
5,951,013 A * 9/1999 Campanella ..... 273/303
6,022,023 A * 2/2000 Ford, Jr. ..... 273/298
6,254,099 B1 * 7/2001 Pederson ..... 273/262
6,322,077 B1 * 11/2001 Braunlich et al. ..... 273/292
6,334,613 B1 * 1/2002 Yoseloff ..... 273/274
6,402,152 B1 * 6/2002 Kutzik ..... 273/244

* cited by examiner

*Primary Examiner*—Henry C. Yuen
*Assistant Examiner*—Arnold Castro
(74) *Attorney, Agent, or Firm*—Ostrolenk, Faber, Gerb & Soffen, LLP

(57) ABSTRACT

A card game that can be played with physical cards, or alternatively, as a computer game, video game, electronic game, and the like. The game incorporates both elements of chance and strategy and allows for cards to become collectible, some of which are provided as rare cards to add to the excitement of the game. Key rules of the game, such as the flow render the game a real time card game in which plays are made, not by turn, but by a mechanism which involves the elements of chance, strategy and players' abilities. The power, effectiveness and functionality of cards can dynamically change.

23 Claims, 4 Drawing Sheets

CARD GAME AND METHOD THEREOF FOR PLAYING A REAL TIME CARD GAME

BACKGROUND OF THE INVENTION

The present invention generally concerns card games and is directed, more particularly, to a card game and method therefor that utilizes novel cards for the playing of a card game that combines chance, strategy, real time play and which eschewes strict adherence to conventional players taking turns. The excitement of the game can be enhanced by making certain cards less available, creating collectible cards valued for their rarity.

Cards have been used throughout the centuries as a means of entertainment. In the twentieth century, many new features have added to the evolution of card games. Cards have become collectable items, baseball cards being one example. Some cards are purposely made more rare that others. In the late twentieth century, card games and the hobby of collecting cards began to merge as with trading card games. The card game and method of the present invention continues the evolution of card games into the twenty-first century.

Conventional card games rely on player turns, like chess where each player has his turn and is able to perform all his actions. The present invention concerns a "real time" card game (RTCG). In a real-time card game (RTCG), players do not take turns. Rather, the game seeks to recreate the feeling of a real life event like boxing or karate, where athletes rely on their skills and abilities to attack each other, with each boxer constantly looking for openings and avoiding punches, waiting for the best moment to make a move. There are no turns. Whoever is able to make a move does so. In a real-time card game control is either player based, random event based, or based on a variable factor, but is not based on set rules. In a real-time card game, there is no predictability as to who goes next, adding to the excitement and competitiveness.

The present inventors are unaware of games with real time play where the deciding factor of who goes next is defined or affected by the players' prior actions. An example of a trading card game is provided by U.S. Pat. No. 5,662,332, the contents of which are incorporated by reference herein.

SUMMARY OF THE INVENTION

Accordingly, it is an object of the present invention to provide a more exciting and life-like card game.

It is another object of the present invention to provide a card game and method therefor which is played in real time, without adherence to turn rules.

It is yet another object of the invention to provide a card game with collectible cards that are collected among players and fans of the game.

Yet another object of the invention is to provide a real time card game and method therefor which deviates from conventional notions of permitting players to draw only a fixed number of cards from a deck in accordance with strictly prescribed, number-based rules.

A still further object of the invention is to provide a card game in which the effectiveness and power of the cards is capable of continuous change during dynamic playing and where different cards belong to different classes and serve different game roles.

The foregoing and other objects of the invention are realized with the card game of the invention which employs a plurality of cards, preferably collectible cards that are played on a playing surface. A variety of cards include, so-called, gladiator cards, counter cards, and other cards that fall into a plurality of card classes and categories. Cards in different classes have different playing abilities. Within a class of cards, the invention employs "discipline" cards which represent a category or ability within a class. The "gladiator" card is the main character that is controlled by each player. The value, effectivity, and power of different cards is subject to variation based on changing factors in the game like the concept of "power level" employed by the invention.

The invention employs a "flow control" strategy that determines who has control of the game at each moment and which involves a large number of different game facilities, such as attack phases, reversal rolls, reliance on bonuses and a large number of other parameters which make for a more challenging and exciting game, as described in greater detail further on.

As but one further note, the invention allows the player/s to break with the current limitation of replenishing their hands by taking cards upon the completion/beginning of a turn.

Other features and advantages of the present invention will become apparent from the following description of the invention which refers to the accompanying drawings.

DETAILED DESCRIPTION OF PREFERRED EMBODIMENTS OF THE INVENTION

I. Introduction and Overview

Figure 1:
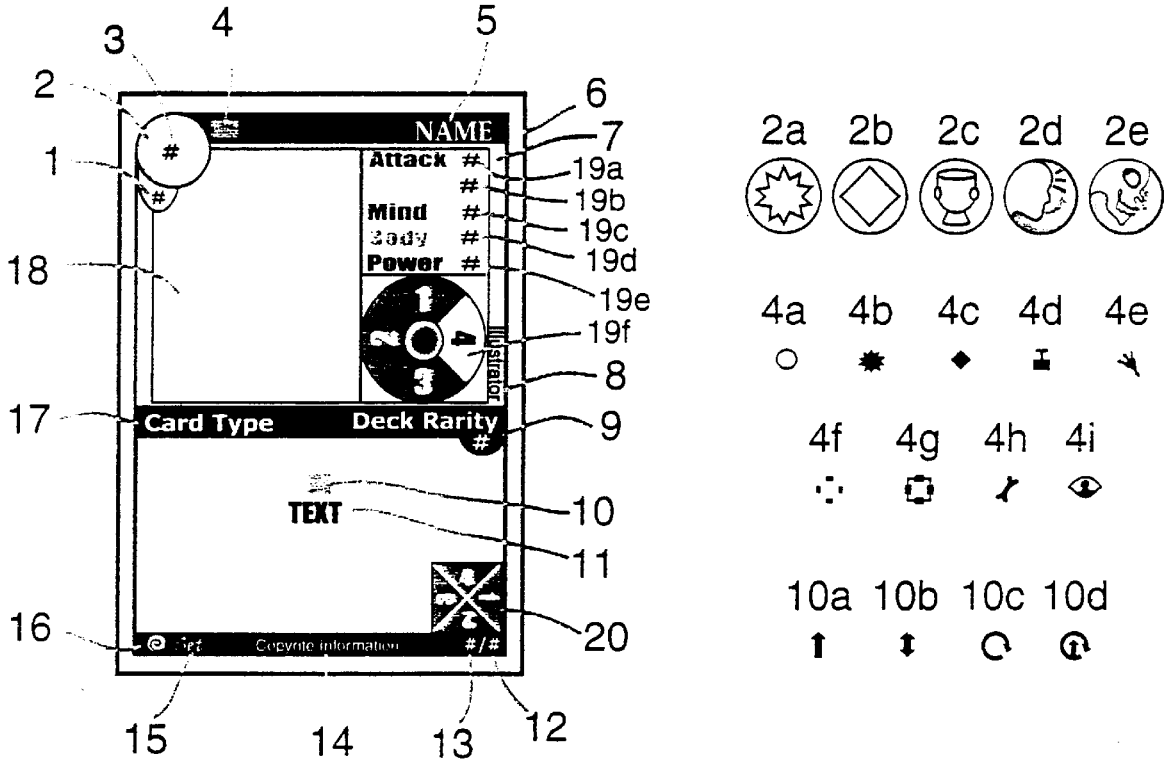
FIG. 1 depicts the features of the playing surfaces of the playing cards.

Main points to appreciate about the invention include:

1. The real time card game attribute;
2. The invention optimally uses set drawings, but can be played without drawings;
3. Rarity (collecting);
4. Alter effects;
5. At least two ways of being eliminated from the game;
6. Character personalities;
7. Powering-up;
8. Class points;
9. Warnings; and
10. Counter Cards, both designs and open to all variations including on play mats and other surfaces.

The above points are elucidated below:

1—Real Time Card Game Play

A Real-Time card game uses non-turn based rules. Real time refers to the structure or nature of game play between players. Games can either be real time or turn based. Turn based games are games where each player takes a turn to play, then passes to the next player like chess. Real time refers to games in which actions are performed in an approximation to the flow of the actual events that they portray. Real time does not mean that the game happens in true time but as an approximation thereof.

In a real time card game, a player-based, random-based, or variable-based factor determines who is to be the next player to gain control. In all known card games including trading card games, that determination is set at the start of the game in a turn based system that normally can not be altered in any way by the players. In one form of the invention, our real-time method is based on the "flow".

Below are some examples of how the real-time card game works:

1) Control is based on a series of rolls or flips of a coin or any other random method with preference towards methods that can be controlled or tampered with so that strategy can be added to their outcome, that end with a determination of the winner of the exchange who gains control. For example, Player 1 tries to attack player 2. They roll dice, and player 2 beats player 1 so player 2 goes next.
2) Control is based on some random element kept to chance so that the result is constantly changing that decides the performer of the next action but no more. For example, both players try to attack each other at the same time, both roll a die, and the one with the best roll gets his attack successful. Then they start over and roll again. Determined at the moment, not before hand by player control, like in the first example.
3) Any other randomly determined method of determining order of player action.
4) Any method used to determine who goes next by looking at a variable element that exists within the framework of the game: e.g. whoever has lowest life goes next.
5) Player 1 plays a card against player 2. Player 2 must answer a question on the card. If player 2 is wrong, then player 1 goes next.
6) Player 1 and player 2 must move their respective cards from one spot on the table to another. Whoever does it first gets to play the card's effect.

2—Drawing Methods

Just as the real-time method of play is a stride in the development of the modem card game, drawing innovations are the next big step. One form of the invention has kept elements of the known style of drawing because it fits conventional game frameworks, but has applied it to the real-time card game in a manner not limited to drawing only after the cycle is over. Section 2.2 (presented further on) describes the drawing in detail.

In a form of a RTCG, as soon as the player uses a card, new ones are taken from the players' repertoire to fill their hand to either allowed capacity or until a card can be used so there is no stopping play. Drawing of this kind is not feasible to any effective measure without a real-time engine because in a turn based system a player would keep picking up after using cards, making turns unbalanced and never-ending. In a real-time card game, since a player can lose the flow because of many factors, those factors would still force the player to lose control regardless of what method is used for picking cards.

Constant drawing also fits with the theme of real-time play because it makes play more fluid and dynamic. Constant drawing eliminates the need for any stoppage of play for drawing or a draw phase, meaning players stay within the more action orientated part of the game for a longer time without need to do the more tedious parts of the game which stop the flow.

Here are other drawing methods that can be used with a RTCG:

1) Picking up a card once one card is placed on the playing field, this is essentially replacing the used card with a new card.
2) Picking up cards until one is found that meets the players needs.
3) Picking up cards as needed (for limited/unlimited hand size).
4) Picking up to your opponent's number of cards or vice versa.
5) Splitting decks up initially between players and using cards until hand runs out or playing with full decks until cards run out.
6) Or any other method involving picking up card/cards after/before a card has been used/after the effect of the card/cards has occurred.
7) Picking up after a random roll or variable based factor determines the number needed.

3—Rarity and Types of Packs

One form of the invention is intended to be bought in a variety of ways so that every type of player or collector will be satisfied. Collectors may choose to find all the rarest types of cards whereas players will find that most cards are available in easier to find forms with less value so that their are game playing ability will not be hampered by rarity.

To add more variety and flavor to the game, new cards will be released which add new rules, cards and functionality to the product. Some cards will be more abundant than others.

4—Alter Effects and Rules

The game functions with additions and changes in rules usually stated on cards. That is, the cards will have rules printed on them that would change a pre-existing rule. For example, a card will say roll two dice instead of one. This is a change in the rules.

5—Losing the Game

There are at least two ways of being eliminated from the game, either by losing all your life points or receiving enough warnings to be disqualified.

Life points are normally lost in combat each time a gladiator is damaged.

Warnings are received because of voluntary or involuntary violations in the rules such as performing an action out of sequence because a player forgot to do it before. See Section 4.8 Warnings explained in the rulebook presented further on.

6—Character Affects Deck Mechanics

In one form of the real-time card game, deck construction revolves around the character with which a player chooses to represent himself. Each character has different abilities and limitations that change the type of cards available to the players in their decks. The character adds an extra level of strategy to deck construction because the choice of character affects the abilities of the deck in very meaningful ways. Players must not only use great decks, but must also weigh in the effect that the choice of character will have upon that deck.

With the character card, even the same deck can have a varying personality and playing style. This adds to the player's sense of playing or becoming that character, an important element to the fun of the game. Each class plays differently, and within each class each character plays differently, giving the game a unique personality for every player, allowing them to have more fun trying many different characters and styles and increasing the chance of the player finding a style that they enjoy. Bringing this human element into the game is a big step forward from most games that don't address this issue, leaving those games without the character and personality elements that the invention brings out so well.

In the invention, the character card is called the gladiator card.

7—Powering-up

As a gladiator successfully performs basic attacks, he gets more powerful. That is, he is able to use more effective cards. The basic attacks add in a pyramid. Powering up allows a gladiator to improve throughout the course of a game in direct relation to how well he fights. This is a big step forward from other games that lose strategy by relying on simple random drawing of cards or set intervals for increasing the power of the players during a game. See Section 3.2 Power Level.

8—Class Points

Each gladiator belongs to a class and each class has its own set of cards. Many of these cards require the expenditure of class points in order to be used. Each character card states how many class points a gladiator has during a game. These points are used and reused. Some cards require an additional maintenance cost to keep them in the arena, which changes the balance of points available for the gladiator during a game, increasing the player's need to plan and coordinate his moves.

9—Warnings

The game's warning system is the first of it's kind in a card game. It takes all of the most controversial, user-unfriendly, and debugging related issues that card games are prone to, and combines them into a fun, easy to use system. Some of these card game related issues that the warning system fixes are:

(a) Since players are responsible for learning and implementing the rules of the game, card games are prone to misunderstandings and player mistakes. Since card games pit players against each other, neither would choose to give help to an opponent or admit to an error in play. The warning system solves these problems by giving players guidelines for dealing with these situations instead of making them figure it out on their own. With warnings, errors become a part of the game, allowing players to accept them and deal with them in a fair way.

(b) When players draw terrible hands in even the most strategic of card games, there is no remedy. Players are stuck frequently with terrible cards and the strategy of the game is lost. The warning system of the invention allows players to take warnings for the chance of improving their beginning hands. The warnings limit the use of this feature, but allow the strategy and choice to re-enter the game in a situation that all other games leave to chance. Only with warning limits is this possible, because players may lose the game if they take warnings for other reasons, meaning they can't exploit the rule.

(c) When card games release cards that they later find to unbalance the game they are simply removed from play and circulation. This is not fun for the player who must suffer for the mistakes of the company in play testing. The present warning system allows players to use these cards by giving warnings for their use in play. This means that if they use them, they gain the added power of the card but they risk losing the game for that added power. This way the option is given back to the player, not forced upon them by the company that produces the game.

(d) Lastly, because all of the elements are brought together, fixed, and implemented within one system, the warnings become an interesting, dynamic part of play instead of part of the burden of playing card games.

10—Counter Cards

In past card games, players had to keep track of certain items such as life without any system provided to help with the task. This was usually done with tons of counters such as coins or tokens. This can get messy and confusing. The inventors have created cards for keeping track of numbers for this very reason.

Since the device is in the form of a card, it's easily stored with the game and cards, making it extremely convenient to the player, and since almost any counter can be used on it, players of any kind will never be at a loss to find a way to use it. The card uses large numbers so that values are easy to read, way better than any other counting method available, and reduces the number of counters needed from 10 or more down to only one or two. The counter card is usable with almost any game that uses numeric values from a range of 0-40 or more depending on the type of counter card used.

II. Cards Features and Functions

With reference to the figures, numeral 1 in FIG. 1 represents the maintenance cost for disciplines indicated on certain cards. Cards may or may not have a maintenance cost associated with them. Numeral 2 is the location of five different symbols, with each symbol representing a different card category. There are Universal Class Categories, including:(a) Attack, (b) Modifier, and (c) Influence, as well as Specific Class Categories, including:(d) Psychomancer, and (e) Necromancer.

Numeral 3 represents the performance cost of the card. For a 2(*a*) class card, the number represents the minimum PL needed to meet the card's performance cost. For a 2(*b*) card, the number represent the amount of class points of any class type that must be expended to meet the card's performance cost. For a 2(*c*) card, the number represents the amount of Influence points that must be expended to meet the card's performance cost. For 2(*d*) and 2(*e*) cards, the number represents the amount of class points from class 2(*d*) and 2(*e*) cards, respectively, which must be expended to meet the card's performance cost. Not all cards within the same card category or even card type behave in the same way when they enter the arena. The symbol in area 4 fulfills this function and many may be used irrespective of Card Type or Class Type. The behavior types include: (a) Instant, (b) To PL, (c) Modifier, (d) Pump, (e) Secondary Character, (f) Regular Pinwheel, (g) Combo Pinwheel, (h) Undead, and (i) Illusions.

Numeral 5 identifies the name of the card, numeral 6 the outer border of card, and numeral 7 the inner border of card. The color of the inner border facilitates identification of the Card Category of a card. For example, an orange border represents a Universal Class Category; a blue border represents a Psychomancer Class; and a black border represents a Necromancer Class.

Numeral 8 is the illustrator of 18's name, and Numeral 9 indicates the deck rarity of a card represented both in text and number forms as, for example, Unique 1, Precious 1, Rare 2, Uncommon 3, Common 4, and Ordinary 5 or more.

Numeral 10 is a symbol representing the way in which a card's action is performed within the game: (a) Single Action, (b) Multi-action, (c) Continuous Action, (d) Semi-continuous Action, or (e) Reaction (can be combined with 10*a*-10*d*).

Numeral 11 is text detailing the effects of an Action. A card may have more than one Action, in which case each would need its own Symbol (10) and Text (11). The total number of unique cards created with the card's set is indicated at 12(*b*). Numeral 13 is a unique number representing the card within its set. Copyright information is at location 14 and numeral 15 is what set a card belongs to. Symbol 16 represents the Rarity/Chance of obtaining a copy of the card. Numeral 17 defines the Discipline within the Card Category (2) that a card belongs to, including for 2(*a*)—Basic Attack, for 2(*b*)—Reversal Modifier, for 2(*c*)—Ally, for 2(*d*)—Illusion, Mind Alter, Read Mind, Self Control, and for 2(*e*)—Disease, Seance, Raise Dead, and Re-shape Dead. Numeral 18 is a picture for the card.

Some cards may represent secondary characters (19), e.g., (h) and (i) represent Secondary Character types. These cards require the following information: (A) Attack Stat, (b) Reversal Roll Stat, (c) Mind Stat, (d) Body Stat, (e) Power Stat, and (f) Damage wheel.

The pinwheel (20) is displayed when either 4(*f*) or 4(*g*) are present on a card and represents the number of uses that the card has available. One of two symbols of 21 represent different gladiator classes: (a) Psychomancer, and (b) Necromancer.

Numeral 22 is a number representing the Class Points (CP) of the Gladiator card, while 23 is the inner border of card. The color of the inner border helps with the easy identification of the Class of the Gladiator card, e.g., blue border—Psychomancer Class, and black border—Necromancer Class.

The Max Basic Attack Level (MBAL) of the Gladiator card is at 24, the Max Reversal Roll (MRR) of the Gladiator card is at 25, and the Max Discipline Level (MDL) of the Gladiator card at 26.

Numeral 27 is the Mind Stat of the Gladiator card, numeral 28 is the Body Stat of the Gladiator card, and numeral 29 is the Power Stat of the Gladiator card. Numeral 30 is special information which differs depending on the Gladiator card's class. Numeral 31 is a number representing the life bonus of the Gladiator card. The life bonus may be a negative or positive number. Numeral 32 is the level needed to use a Gladiator's special ability or attack. The text detailing the effect of a gladiator's special ability or attack is at 33. A gladiator may have more than one special ability, in which case each would require its own Level (32) and Text (33).

Numeral 34 is the Class of the Gladiator stated in words, while numeral 35 is the number representing the Influence points of the Gladiator card. Numeral 36 is the large portrait of the Gladiator. Numeral 37 is a biography of the Gladiator. Numeral 38 indicates the color of the counter card. Different colors help distinguish the roles of the cards as chosen by the players in the game and also add variety. Numeral 39 is one of the numbers which are separated in integrals of one. 40 is a circle used to help in placement of counters on the card and for easy recognition from players seated at a distance. 41 is one of the numbers which are separated in integrals of five. Numeral 42 is a track line that helps players in moving counters between the numbers in the proper order. Numeral 42 is a zero space for keeping counters when not in use. And numeral 44 is one of the numbers which are separated in integrals of ten.

III. The Invention Rule Book

Part 1: The Basics 1.1 Quick Play Game (Note: Quick Play doesn't use all the rules. It establishes an understanding of how the game works on a basic level)

Setup: Give one deck to your opponent and keep one for yourself. Then take the top card known as the gladiator card, and place it in the center of the table. Refer to table layout diagram.

Shuffle: Shuffle the remaining cards and place them face down next to you in a pile. This will be your repertoire. Then draw several cards, preferably seven, from your repertoire. This will be your hand. Have your opponent do the same with her deck.

Who Goes First: Take the two six-sided dice from the starter's pack. Give one to your opponent and take one for yourself. Roll your die, then have your opponent do the same. Whoever rolls higher, goes first. If there's a tie, roll again.

Figure 5:
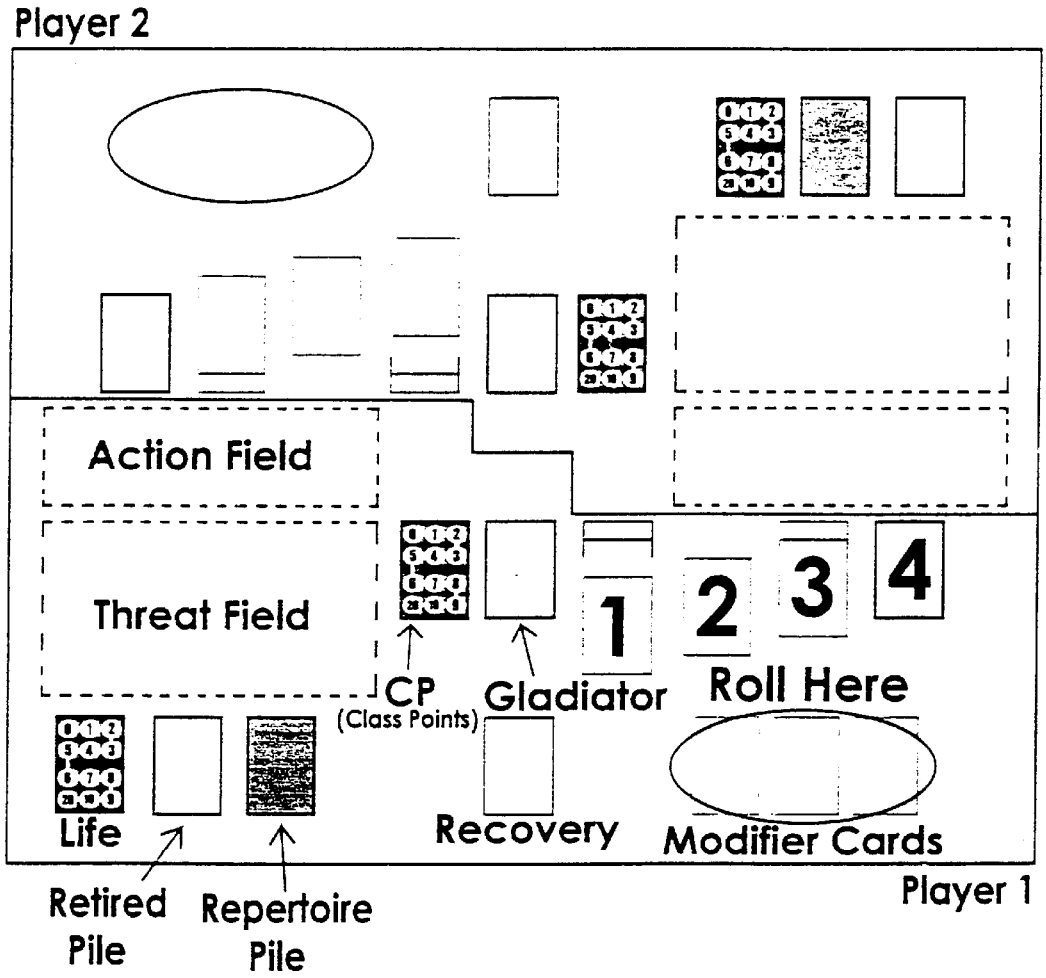
FIG. 5 represents the table layout.

The following rules apply to whomever goes first:

Performing an Attack: Look through your hand for a card with a 1 in the upper left-hand corner. That 1 means that the card is a first level attack. If you have a first level attack, you may use it by placing it in the recovery pile, under your gladiator card as shown in FIG. 5—table layout. This will be called performing an attack.

If you don't have a first level attack, your opponent may go. If both of you don't have a first level attack in your hands, discard all your cards and draw seven new ones.

What to Do When Your Repertoire Runs Out: Once you've drawn so many cards that your repertoire has no more, you must take your recovery pile and turn it face down and place it where your repertoire used to be. You now have a repertoire again. Continue this process of converting your recovery into your repertoire each time you have to draw a card from an empty repertoire. Do not shuffle your recovery pile when converting it to your repertoire.

Resolving an Attack: After you play your attack, your opponent and you must roll your dice. If your roll is higher, the attack is successful and you get to go again. If your oponent's roll is higher, the attack fails and he gets to go. If there's a tie, the attack fails, but you get to go again.

Powering Up: If the attack is successful, place the attack card to the right of your gladiator card. This attack card counts towards your power level. The more cards in your power level, the higher the level of the attack cards you can use. If you perform another successful attack, stack it on top of the first card as shown in FIG. 5—Table Layout. Stack cards so you see how many you have.

Once you stack at least 2 first level attacks, you can use second level attacks. A second level attack has a 2 in the upper left-hand corner. Successful second level attacks are stacked to the right of the first level attacks as shown in FIG. 5—Table Layout.

Once you stack at least 3 first level attacks and 2 second level attacks, you can use third level attacks. Successful third level attacks are stacked to the right of the second level attacks as shown in FIG. 5—Table Layout.

Winning the Quick Play Game: Once you stack at least 4 first level attacks, 3 second level attacks, and 2 third level attacks, you win!

1.2 Game Overview

The object of the game is to defeat your opponent in a duel. Once all your opponent's life is gone, he is considered defeated.

The cards have different effects. Some damage an opponent and reduce his life, while others do special things that help you win the duel. Once a duel starts, you and your opponent will fight each other using basic attacks like punches and kicks. You must struggle to keep control because at any moment your opponent may steal your momentum by reversing your attacks just like in a real battle. The more attacks you do, the more powerful you become. The more powerful you are the better the attacks you can perform.

As you open up new levels, your gladiator's special abilities become useable. Once you are at your highest power level, your gladiator's most effective attacks are unleashed. Different gladiators have different skills, so be sure to choose the one that's right for you.

You may also use allies like the Demon Imp that help you fight, or class-specific disciplines like diseases and illusions.

Below is a list of the three gladiator classes you may choose from, take a look and choose the class you think sounds interesting to you.

1.3 What Gladiator Class is Right for You?

Cyborgs: These incredible physical specimens are capable of enhancing their bodies and minds with technology. Cyborgs concentrate mostly on offensive and damage related abilities and enhancements.

Psychomancers: Psychomancers use their mind to immobilize opponents. They have very few damage related skills but focus on protection and limiting opponents.

Necromancers: Dealing in death and control of the dead, necromancers use undead creatures and diseases to attack opponents.

Once you choose a class, pick a gladiator from that class. He will represent you in the arena. If you are using the starter's pack, you are limited to choosing either Ironsides from the cyborg class, Mister Mystery from the psychomancer class, or Lothar from the necromancer class. They are very good starting gladiators, and each comes with his own pre-made deck.

1.4 Categories For Characters:

Character: Gladiator; Secondary Character; Ally; Undead; and Illusion.

A character can be any living being, undead creature, machine, or figment of the imagination. All characters can be attacked and destroyed in one way or another. A gladiator is a character controlled by a player. You and your opponent each play a gladiator. A secondary character is any character that is not a gladiator. It normally helps a gladiator during a duel. For more information on specific secondary characters, see their individual sections (for allies see 4.5, for undead see 4.6.2, for illusions see 4.6.1).

1.5 Winning the Game

You may win the game in one of two ways:

1. By eliminating all your opponent's life.
2. If your opponent gets disqualified after receiving 3 warnings in a match.

If you and your opponent both meet the requirements for winning at the same time, it's a tie.

1.6 Life Blocks

In the invention, the length of matches is determined by life blocks—the number of life all gladiators get at the start of a match. Life blocks have a value of 5 and can be combined to get life values of 10, 15, and so on. Fewer life blocks mean that the game will last a short time while more life blocks would last a longer time. For example, if each gladiator has 5 life (1 life block), the match will be over after a few well placed attacks. On the other hand, if each gladiator has 20 life (4 life blocks), the match can last from half an hour to an hour!

Gladiator Life Bonus: Some gladiators get bonuses to their starting life, but that bonus can not exceed the amount of Life Blocks you choose to play for.

1.7 What are all these piles?

There are three piles in the game. These piles still exist even if there are no cards in a pile. The three piles are the repertoire, the recovery pile, and the retired pile. (see FIG. 5—Table Layout)

Repertoire: These cards represent a gladiator's experience and strategy. When you draw, you take cards from your repertoire. All the cards in your repertoire are face-down. Once your repertoire is out of cards, you take your recovery pile and make it your repertoire.

Recovery Pile: These cards represent a gladiator's attacks and cards that were not successful. Their ultimate fate is to be recycled and reused. All the cards are face-up. When you play a card that might not succeed like an attack or a discipline, you place it on top of the recovery pile. If it is successful, you move it off the pile. If it fails, it stays where it is.

Retired Pile: Cards that are retired go to the retired pile. Retired cards usually don't return to a game. Used corpses, destroyed undead and illusions, completely used or de-maintained disciplines, and quickies are some of the things that go into the retired pile.

1.8 Play Outline

The game is broken into two parts: a setup for an initial preparation and a main loop called the combat cycle that does't end until a victory condition is met (usually when an opponent is defeated). Setup includes: (a) Shuffle; (b) Roll to see who goes first; and (c) Draw.

The Combat Cycle has: (a) a Combat Phase, (b) a Breather, and (c) a start or new Combat Cycle.

(a) Combat Phase: If you have The Flow you may:

Perform a Non-Attacking Action; Attack; Use a Free Action; Pass—Declare that you cannot perform any Actions.

If you don't have The Flow you may: Use reaction cards (b) Breather: Discard, Maintenance, and Redraw (c) Start a new Combat Cycle.

Part 2: Order of Play Breakdown 2.1 Setup

Make sure you and your opponent each have a deck, a die, counter cards, some counters, and a nice table to play on.

Shuffle: This is the point when you must shuffle your deck. When you are confident that your deck is fully shuffled let the player seated to your right cut it while you do the same with his. Place your deck face down to your left (see FIG. 5—Table Layout). This deck, from which you will draw, will be called your repertoire.

Roll to See Who Goes First: Each player rolls their six-sided die. The player with the highest roll goes first. In the event of a tie, simply roll again.

Draw a Hand of Seven Cards: Both players draw seven cards from their repertoire. Drawing cards in the game represents the preparing of a good strategy for your gladiator. All players draw at the same time.

First Hand Redraw: If before the combat cycle starts, you are not happy with your hand, you may discard it all, and draw again. Each time you do this, you receive one warning. Remember: three warnings and you lose the match. Use them wisely.

2.2 Combat Cycle

From this point on, the game is a loop of combat cycles made up of two main phases; the combat phase and the breather phase.

Combat Phase: Almost all the action happens within the combat phase (read Part 3: The Combat Phase).

Breather Phase: The breather is the time when gladiators take a moment to rethink their strategy and come up with new ways to beat their opponents. The breather phase begins when all players pass in sequence and ends when they have redrawn. The breather phase is divided into three steps; discard, maintenance, and redraw.

Discard: First, all players may drop from their hand as many cards as they wish and place them on top of the recovery pile in any order.

Maintenance: Next, players may return single actions, multi-actions, and semi-continuous actions to the threat field (see 4.2 Threats and Actions) so they may be used again on the next combat phase. All players also get back class points not used to maintain any disciplines in play, up to their maximum number of class points (see Maintenance Cost in 4.6.1-4.6.3).

Redraw: Finally, all players draw until they have seven cards in their hand.

Renewing the Repertoire: Once you've drawn so many cards that your repertoire has no more, you are allowed to take your recovery pile and turn it face down and place it where your repertoire used to be. You now have a repertoire again. Continue this process of converting your recovery into your repertoire each time you have to draw a card from an empty repertoire. Do not shuffle your recovery pile when converting it to your repertoire.

Part 3: The Combat Phase 3.1 The Flow

An understanding of the flow is one of the most important concepts you will learn. It is the key to creating fluid action-packed play. In most games, play is defined by the turn. When it's your turn you pick up cards, play cards, and possibly attack. Then, your opponent does the same thing. If you're used to playing that way, prepare yourself for something new. In the invention, the turn is not as important as who has flow.

In a real duel there are no turns. Combatants constantly attack, parry, dodge, and reverse—every move is a struggle for dominance and control. Control is maintained from moment to moment and not divided into static turns. Since this is a game of combat, it makes sense that the game's structure would seek to emulate the pacing of a real battle. This is done through the use of the flow.

Simply put, the gladiator who has the flow is the person who makes things happen. He is the one in control, but that control is not fixed and at any moment his opponent may steal the flow away from him by reversing attacks, etc. Within the course of a single combat phase, the flow may change hands many times fluidly switching from player to player. It's a beautiful thing to behold, just like your favorite martial arts movie played out with cards.

There are eight simple rules that define the flow, and once you understand them, you will also understand the fundamentals of combat.

Rules of The Flow:

1. The player who won the die roll at the start of the game, starts the first combat cycle with the flow.
2. You may only perform an action if you have the flow, unless the action is a reaction.
3. The attacking player maintains the flow if the defending player cannot reverse the attack or the attack is blocked.
4. The defending player gains the flow if he successfully reverses an attack.
5. When a player performs a non-attacking action or passes, that player loses the flow and control switches to his opponent, unless that action is a free action.
6. When the last action of all players is a pass, the combat phase ends.
7. Whoever passed first before all players pass, will have the flow at the start of the next combat phase.
8. Stun and other temporary effects do not carry over into the next combat cycle.

Example 1: It is the start of the game and Lothar won the roll and has the flow (rule 1). He punches Ironsides (rule 2) and Ironsides reverses (rule 2). Lothar re-reverses and Ironsides can no longer block the attack, if Lothar would have been unable to counter Ironside's reversal, Ironsides would have gained the flow (rule 4). Since Lothar's attack went through he retains the flow (rule 3), but he passes since he has no more actions.

Ironsides steals the flow (rule 5) and performs his last action, which is an augmentation for his cyborg. Since it is a non-attacking action, control switches back to Lothar (rule 5). He passes and so does Ironsides. Now that both player's last actions were passes, the combat phase of the combat cycle ends (rule 6). Since Lothar passed first, he will have the flow at the start of the next combat phase (rule 7).

Example 2: Ironsides has no actions. Lothar steals the flow by playing his only action, an attack that does stun, a temporary effect. Ironsides cannot reverse the attack so it goes through, but now Lothar is also out of actions.

He passes and so does Ironsides. Now that both player's last actions were passes, the combat phase of the combat cycle ends. Since Lothar gained the flow, he will have it at the start of the next combat cycle, but the stun does not carry over (rule 8).

The Five Types of Flow-Related Actions

Attack: An attack is an action directed by a gladiator only against another gladiator. It causes damage or some other effect. Generally, this type of action reduces a gladiator's life and requires a reversal roll. You could either keep or lose the flow after performing this action depending on the success of the attack (see Rules of the Reversal in 3.3). You can only perform this action if you have the flow.

Attacking Actions: (A) Basic Attacks directed by a gladiator against a gladiator; and (b) Gladiator special attacks directed against a gladiator.

Non-Attacking Action: This type of action is not an attack against a gladiator, but it takes time to perform and flow is lost. You lose the flow automatically after performing this type of action. You can only perform this action if you have the flow. Non-Attacking Actions include: (a) Performing a discipline; (b) Calling out allies; and (c) Attacking secondary characters—Gladiator special abilities Free Action: If you perform this type of action, you will still keep the flow. It takes up barely any time so flow is kept. You cannot perform a free action when you do not have the flow. Flow is kept even if the free action is unsuccessful.

Free Actions include: (a) Using disciplines already in the arena (Single, multi, semi-continuous); (b) Using Ally abilities (Single, multi, semi-continuous); and (c) De-maintaining disciplines Pass (No Action): Naturally, if you don't do something, your opponent will take that opportunity to try to do something. In the game, if you have no actions, you say you pass and your opponent gets the flow. You can only pass if you have the flow.

Reaction: This is the only action you can perform when you don't have the flow. However, the opponent must perform a certain action to trigger a reaction from you. A reaction card can be used only once for any one action. For example, you are being attacked for four damage and you have a reaction card that blocks one damage for every time the effect is used, it can only be used once, not four times because no reaction card may be used more than once for a single action. Reaction cards will list the action that will allow them to be used within the text (FIG. 1, 11).

For example, If you were to have the following text, "When damage is applied to your gladiator from an attack, draw a card.", the action that would allow you to use it would be when damage is applied to your gladiator from an attack. In all other cases the reaction card would be unusable.

Reactions include: (a) Reversal Rolls; and (b) Reaction Cards.

3.2 Power Level (PL)

The invention's goal is to replicate a real duel. In any duel, the better you do, the more your self-confidence improves, which in turn leads you to trying riskier attacks. Seldom in a duel does someone start with a complex or difficult attack like the death grip. First you throw in a few kicks and punches and then, as your confidence improves and your opponent weakens, you use more "powerful" attacks.

Max Basic Attack Level (MBAL): Every gladiator that enters the arena, regardless of class, possesses some basic fighting ability. In the invention, your gladiator's basic fighting ability is listed on the gladiator card as MBAL. There are three basic attack levels. Don't despair if your gladiator's MBAL is low. This is a measure of his basic fighting ability only. Chances are if your MBAL is low, your gladiator will make up for that in other ways. Every gladiator has his strengths and weaknesses.

In order to perform a basic attack, your gladiator must be at the PL listed on the top left corner of the card (see Powering Up below). Regardless of PL, you cannot use a basic attack with a level higher than your MBAL.

Example 1: Ironsides is at PL 1 and his MBAL is 3. At this point he can only use first-level attacks, but can, through the coarse of the duel use basic attacks as high as third-level.

Example 2: Lothar reaches PL 3 but his MBAL is 1. He, like Ironsides in the above example, can also use only first-level attacks, but since his MBAL is 1 will never be able to use higher level basic attacks.

Max Discipline Level (MDL): MDL represents the gladiator's ability to perform some disciplines. Some disciplinary cards have a PL requirement. A gladiator with an MDL lower than a certain disciplinary card's PL requirement cannot use it. In order to perform a discipline, your gladiator must be at the PL listed on the card (see Powering Up below). Regardless of PL, you cannot use a discipline with a level higher than your MDL. Note: first-level disciplines do not have the level written on the card, so if a discipline card does not say what level it is, it is first-level.

Example 1: Mr. Mystery is at PL 1 and his MDL is 3. At this point he cannot use disciplines of second-level or higher. However, if his PL raises to 2 or 3, he can use second-level and third-level disciplines respectively. Note: he cannot use fourth-level disciplines no matter what his PL is.

Example 2: Ironside's MDL is 1. He can use only first-level disciplines no matter what his PL is.

Max Reversal Roll (MRR): MRR represents a gladiator's chances to either reverse attacks against him or perform attacks against his opponent. It is the maximum number of reversal rolls a gladiator can get to reverse or execute an attack (see Reversal Rolls in 3.3). Each player gets his current PL no higher than his Max Reversal Roll (MRR) worth of rolls to either stop the attack or make it go through, depending on whether they are the defender or the attacker. (see 3.3 Making an Attack)

Example 1: Lothar's MRR is 2. At PL 1 he gets 1 reversal roll, at PL 2 he gets 2 reversal rolls. However, if he reaches PL 3 or more, he will still have 2 reversal rolls.

Example 2: Mr. Mystery's MRR 1. He gets only 1 reversal roll no matter what his PL is.

Powering Up: The invention is based on the "power" factor. Every player's goal is to perform more powerful attacks, which in turn makes your opponent weaker. The PLs work in a pyramid. Your PL is affected with every single attack you perform. Simply put, the more successful attacks you perform, the more powerful you become. Each player is required to power up in the following manners. Here's how you power up if your MBAL is 3:

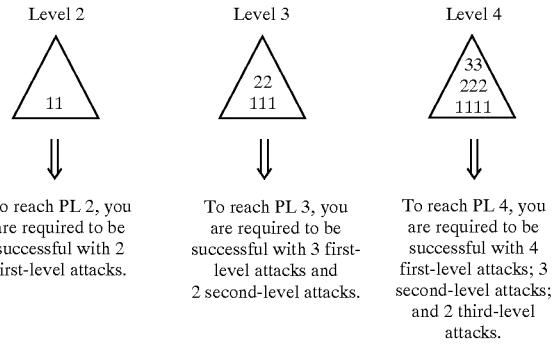

You might ask, what if my MBAL is 2, how do I get to the third and fourth PLs? Simply use your highest possible MBAL level to replace any higher level required attack as shown below:

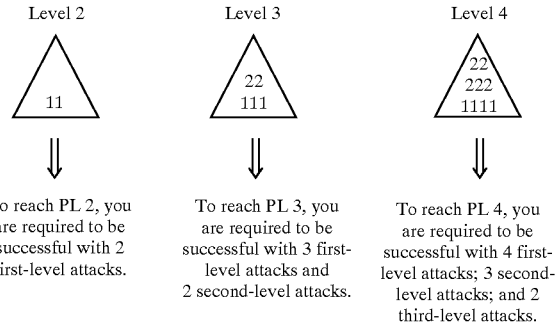

Or if your MBAL is one, here is what you would use:

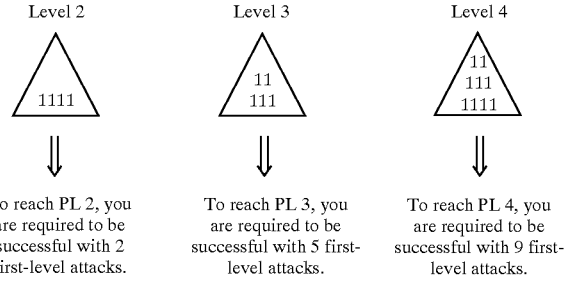

Figure 4:
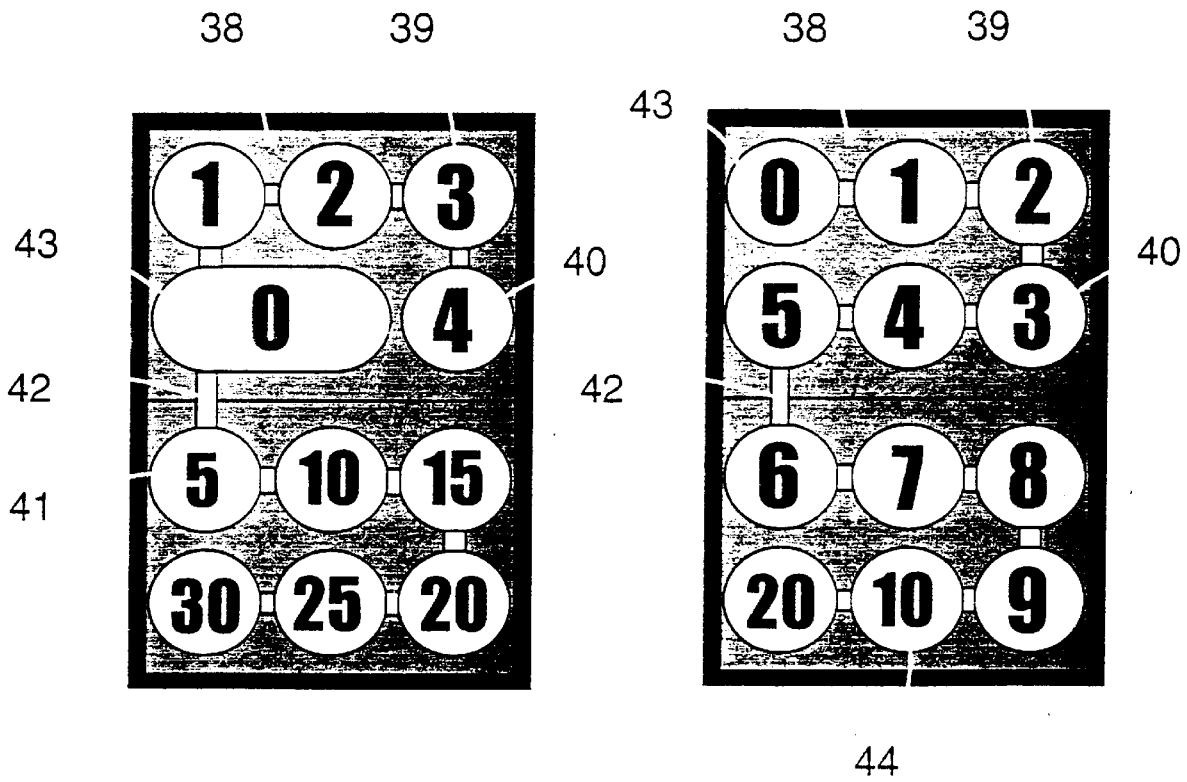
FIG. 4 represents the features of the counter card.

Note: Not every attack a gladiator successfully performs will count to his PL. Look at the symbol on the left-side. If it is a (FIG. 1, FIG. 4*a*) then the attack does not add to PL and is usually retired after it is performed. If the symbol is a (FIG. 1, FIG. 4*b*), then it adds to PL.

Example: Ironsides MBAL is 3. He has performed 5 first-level attacks and 1 second-level attack. He is at PL 2 and cannot reach PL 3 until he performs one more second-level attack.

Note: When playing the invention, you will use a the setup in FIG. 5 Table Layout. Stack all successful attacks that add to PL to the right of your gladiator card by level starting with first-level closest to your gladiator and moving to the right with every attack level. The first-level stack is to the right of your gladiator card. The second-level stack is to the right of the first-level stack. The third-level stack is to the right of the second-level stack.

Powering Up (an alternative): The invention is based on the "power" factor. Every player's goal is to perform more powerful attacks, which in turn makes your opponent weaker. Our PLs work in a pyramid. Your PL is affected with every single attack you perform, the more powerful you become. Each player is required to power up in the following manners. Here's how you power up:

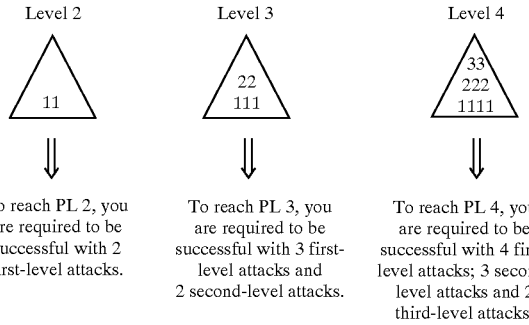

Powering Up (Another Alternative)

Each attack you perform gives you points towards the next level. Once you reach a predetermined number of points, you retire your successful attack cards until the points on the cards equal the needed points. Each card gives it's level in points. Next, start towards the next level's point requirement.

3.3 Making an Attack

To perform an attack, a player must first place an attack card on his recovery pile. When a gladiator is attacking his opponent, he and the opponent are using their skills to determine the outcome of the attack. The defender is trying to avoid the attack while the attacker is trying to land the attack.

In the game of the invention, the timing and skill are played out through die rolls called reversal rolls. The defender makes a defend roll while the attacker makes an attack roll. If an attack fails, the card stays in the recovery pile. If the attack succeeds, it goes either to the PL stack (if it contains FIG. 1, FIG. 4*b*), the retired pile (if it contains FIG. 1, FIG. 4*a*), or if the card has stun, to a temporary space in the roll modifier section until the stun is resolved (See stun). Remember that your gladiator cannot perform an attack with a higher level than either his MBAL or his PL.

The Reversal roles are the heart of an attack. They determine the outcome of an attack. Here are the 8 simple rules of the reversal roll:

Rules of the Reversal Roll:

1. Each player gets his current PL no higher than his Max Reversal Roll (MRR) worth of rolls to either stop the attack or make it go through, depending on whether they are the defender or the attacker.
2. Players roll back and forth until one player either fails his roll or runs out of rolls.
3. The defender rolls first, and on the first roll must roll equal to or greater than the level of the attack or else the attack succeeds.
4. After the first roll, players must roll higher than the roll of their opponent to control the outcome of the attack.
5. If the last roll was a tie and the next player still has a roll left, he may choose to either accept the block or take a chance rolling again.
6. If either player ties the last roll and the next player to roll doesn't have a roll, the attack is blocked.
7. If the attacker's successful roll was the last roll or the defender's roll failed, the attack succeeds.
8. If the defender's successful roll was the last roll or the attacker's roll failed, the attack is reversed.

Example 1: Ironsides is at PL 2 and Mister Mystery is at PL 1. Both gladiators' MRR is 3. Ironsides has two reversal rolls while Mr. Mystery has one (rule 1). Mystery attacks Ironsides with a first level attack. They now start rolling (rule 2). Ironsides makes a defend roll (rule 3) resulting in 3, which is higher than the attack's level. Mystery makes an attack roll (rule 4) resulting in 3, uh oh, his attack might be blocked! Ironsides decides to try to break the tie (rule 5) and makes his second roll resulting in 6. Mister Mystery is out of rolls so Ironsides reverses the attack.

Example 2: Ironsides attacks Mister Mystery with a second level attack. Mystery rolls a 1 and fails to reverse the attack (rule 3).

Example 3: Again, Ironsides attacks Mystery with a second level attack. Mr. Mystery rolls a 2. Ironsides rolls a 1, ouch, failing to beat Mystery's last roll (rule 8). Mr. Mystery reverses the attack and gets the flow.

Example 4: Mystery attacks Ironsides with a first level attack. Ironsides rolls a 9. Mystery rolls a 10. Ironsides rolls a 4, and the attack is successful (rule 7). Mystery goes to PL 2, now he has two rolls (rule 1).

Example 5: Mystery attacks Ironsides with a second level attack. Ironsides rolls a 4, Mystery 5. Ironsides rolls a 5. Mystery uses his newly acquired second roll thanks to his raise in PL and tries to beat the 5 but ties it instead. The attack is blocked (rule 6).

3.4 Rolls

Natural Roll: A natural roll is whatever number appears on the die after it is rolled.

Altered Roll: An altered roll is a modification of a natural roll.

3.5 Modifying Rolls (See 4.7 Reversal Modifiers.)

3.6 Basic Attack Modifiers

Some attacks have a modifier to the reversal roll. This modifier is applied during that attack. For example, the Hammer Punch does 2 DMG and has a −2 attack roll. That means the attacker suffers the −2 to his reversal rolls.

3.7 Resolving Attacks

Successful Attacks: If the attack was successful and the attack contained stun: Move the attack card to a temporary space in the roll modifier section until the stun is resolved.

If the attack was successful and the attack contained no stun or the stun was resolved and:

1) had a (FIG. 1, FIG. 4*b*), place it to the right of your gladiator card in the row where it belongs (See 3.2 Power Level).
2) had a (FIG. 1, FIG. 4*b*), place it in the retired pile. These kinds of cards are called quickies and are retired after their effect is over.

Failed Attacks: If the attack was blocked or reversed you leave it in the recovery pile.

3.8 Reversal Roll Outcomes

Reverse: If a defender reverses his opponent's attack, that attack fails and stays in the attacker's recovery pile and the defender gets the flow.

Block: If a defender blocks his opponent's attack, that attack fails and stays in the attacker's recovery pile, but the attacker keeps the flow. Blocks are results of tied rolls.

Success: If the attacker beats the defender in reversal rolls, the attack is successful and the attacker keeps the flow. Below are some effects of the many attacks known in the invention.

3.9 Effects of Attacks

Damage: Damage is the result of an action, usually an attack, which reduces a player's life. For every point of damage, subtract one point from the successfully attacked character's life (see 3.11 Counter Cards and Life and the Damage Wheel in 4.3 Secondary Character).

Stun: Stun is an effect that counts toward the next attack performed involving the stunned character as long as that attack immediately follows the one that caused the stun. Thus, stun is lost if the next action is a non-attacking action, an attack not involving the stunned player, or if the combat phase ends. Free actions do not lose stun nor does passing. Stun modifies reversal rolls and sometimes does damage. Stun only counts towards the next attack and ends as soon as that attack is made regardless of who attacks.

Stun can affect either the attacker or the defender. If a stun affects the attacker, only the next attack he is involved in uses the stun, whether he is the attacker or defender. If a stun affects the defender, only the next attack he is involved in uses the stun, whether he is the defender or the attacker.

Place any card that does stun on the roll modifier section of the table layout to remind yourself and your opponent that it is there. When it is used, put the card which caused the stun back to the section of the arena where it belongs.

Example 1: Lothar successfully performs a Punch on Madame Petice. Petice now has "stun: +1 DMG" on her. This means if Lothar successfully attacks her again, she gets an additional DMG.

Example 2: Continued from example 1, Lothar successfully performs a Headbutt on Madame Petice who had "stun: +1 DMG" on her. Petice loses a card off her PL as a result of the headbutt. She also takes 1 DMG as result of the stun. The stun is gone once it is used.

Example 3: In another scenario, Petice has "stun: +1 DMG" on her. Lothar commands one of his undead to attack Petice for 1 DMG. If the undead's attack is successful, Petice will take 2 DMG, 1 from the undead and 1 from Lothar's stun.

Example 4: Petice successfully attacks Lothar. Lothar has stun on him as a result. Petice passes. Lothar passes also and the combat phase ends. Petice will have the flow next combat phase, but Lothar's stun will expire.

3.10 Special Abilities and Attacks

Most gladiators have one or more special abilities or special attacks listed on their card. Some of these are useable right away (at PL 1), but most require your gladiator to be powered up to unleash them.

Special Abilities: Every gladiator's special ability has a level requirement listed above it. If you are at that PL or higher, you can use the ability. Your gladiator may only use one of his abilities per combat cycle as a non-attacking action by moving it to the action field.

Example: Lothar's special ability is to cause fear in his opponent's allies. However, he has to be PL 3 to use this ability. Once Lothar reaches PL 3 he may use his fear ability by moving his gladiator card to the action field.

Special Attacks: Every gladiator's special attack has a level requirement listed above it. If you are at that PL or higher, you can use the ability. Your gladiator may only use one of his abilities per combat cycle as an attacking action by moving it to the action field.

When performing a special attack use the power level requirement of the attack as the attack's power level. Special attacks do not add to PL or get retired.

3.11 Counter Cards

Counter cards are a great new way to keep track of your life or other quantities. Each countercard has a set of numbers printed on one face. Put a clear glass bead or other counter on a number on the card. That number under the counter is how many points of something you have, like life. Whenever you have to change the number of points you have, simply move the counter to the new value. Each time you move the counter from a lower number to a higher number, you are increasing your points and each time you move the counter to a lower number, you are decreasing your points. For values of ten or lower you need only use a single counter. If you have points that go above ten, simply use an extra counter. For example, if you have 19 life, you would put a counter on 10 and another on 9. Together, both numbers add up to your total 19 life. In another example if you have 23 life, you would put a counter on the 20 and another on the 3. Together, both numbers add up to your total 23 life.

Part 4: Advanced Play 4.1 Gladiator Card

The gladiator card, out of all the card types, has the most profound effect on the play of your game. The class you belong to, the number of class points you receive, the amount of life you have, your offensive and defensive capabilities, your special attacks, your ability to resist mind, body and power attacks; all these and more are decided by the gladiator that you choose. To help you make the right decision here is a listing of all the factors affected by gladiator choice.

Figure 2:
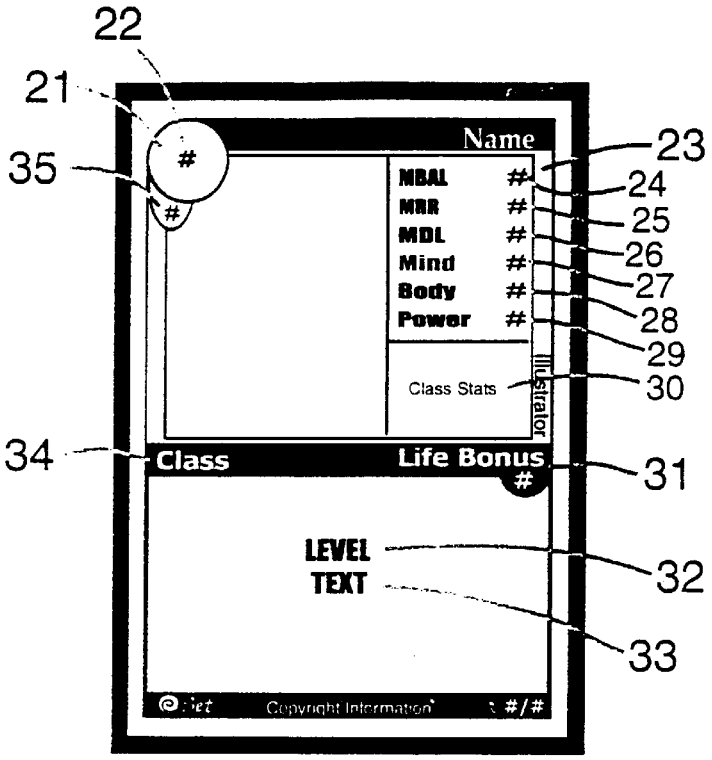
FIG. 2 represents the features of the front side playing surface of the gladiator card.
Figure 2:
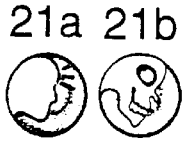
Figure 3:
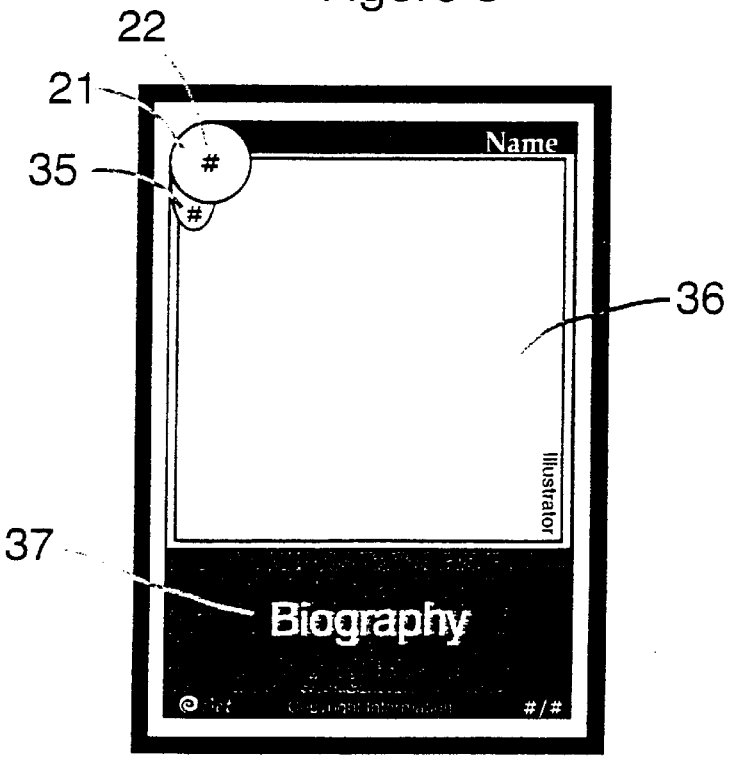
FIG. 3 represents the features of the back side playing surface of the gladiator card.
Figure 3:
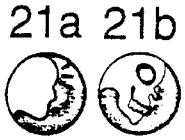

Class Type: You are limited to using only those cards that are either universal or are from your gladiator's class type. Your gladiator's class type is listed both as the symbol in the top left corner (see FIG. 2, 21) and as the name in the middle left corner (see FIG. 2, 34).

Life Bonus: Depending on what life amount you decide to play for, your gladiator can add or subtract to that amount based on his life bonus listed in the middle right side (see FIG. 2, 31) of your gladiator's card. More life helps you survive more damage while less life means you can survive less damage.

Some gladiators get bonuses to their starting life, but that bonus can not exceed the amount of Life Blocks you choose to play for.

MBAL: MBAL or Max Basic Attack Level represents your gladiator's basic attacking ability and limits the level of basic attacks that he may use. (see MBAL in 3.2.)

MRR: MRR or Max Reverse Roles represents your gladiator's technical skill and affects his ability to make his basic attacks succeed and his opponents basic attacks fail. (see MRR in 3.2.)

MDL: MDL or Maximum Discipline Level represents your gladiator's class-based skills and limits the level of disciplines he may use. (see MDL in 3.2.)

Class Points: All classes have a point system available to them. These points are a representation of the Gladiators ability within his class. Some Gladiators are stronger in their class of abilities than others. The stronger a gladiator is within his class, the more points he will have allotted to him.

Influence: The amount of Influence your gladiator has affects the amount of Influence related cards that he can have in play at a time. Allies are an example of a card type that requires Influence. (see 4.4 Influence.)

Mind: Mind represents your gladiator's mental strength on a scale from 1 to 6 with 6 being the highest. A high mind will help you fight off mental attacks.

Body: Body represents your gladiator's inward physical strength on a scale from 1 to 6 with 6 being the highest. A high body will help you fight off disease related attacks.

Power: Power represents your gladiator's outward physical strength on a scale from 1 to 6 with 6 being the highest. A high power will help you fight off powerful physical attacks.

Special Abilities and Attacks: Every gladiator has special abilities and/or attacks that he may use when he reaches the proper PL. Since no two gladiators will ever have the exact same list of these take care to study them and figure out how they will affect the style of his battles. (see 3.10 Special Abilities and Attacks.)

4.2 Threats and Actions

Threats: In the invention, there are two main types of play fields in which you use your allies, disciplines, and other non-basic attacks. The first is the threat field, and the second is the action field.

Threats are thorns in your opponent's side. They are there and he must worry about the possibility of them becoming actions. A threat is something that you may choose to use at any time or at specific times when triggered by something else you or your opponent might do.

Any card in the arena that may perform an action, but is not currently performing an action is called a threat, and is kept in the threat field of the table. Allies that may use abilities but have not performed them yet fall into this category. Beware of your opponent's threats at all times.

Actions: When a threat is used, move it up to the action field of the play field. When a threat becomes an action it is no longer something to worry about, but instead something that requires immediate attention. When you make a threat an action, you are declaring to your opponent that you are making that threat a reality that he must deal with immediately. Whatever the threat's effect, from gaining back life to damaging your opponent, is resolved at that time.

Some cards are only threats once per combat cycle while others can be threats many times per combat cycle. There are four categories of effect actions:

Single Actions: If a card's effect has the (FIG. 1, 10*a*) single action in front of it, this means that once the card changes from a threat to an action, it will remain in the action field until next combat cycle. Once its effect is dealt with, the card remains harmless until it becomes a threat once again next combat cycle.

Multi-Actions: If a card's effect has the (FIG. 1, 10*b*) multi-action in front of it, it may become a threat again immediately after its action effect is performed. Simply move it back to the threat field to show this change.

Continuous Actions: Some cards are continuous actions (FIG. 1, 10*c*) and must stay in the action field. Continuous actions are constantly in effect.

Semi-Continuous Actions: Some cards start as threats but once they are put into the action field have continuous effects. These semi-continuous actions (FIG. 1, 10*d*) can also become threats again the same as a single action.

4.3 Secondary Characters

Secondary characters work with the gladiators to defeat the enemy. Allies, undead, and illusions are all types of secondary characters. All secondary characters have the following features in common with one another:

Secondary Character Abilities

Once a secondary enters the arena you can command your secondary to use it's abilities as a free action. Secondary abilities can be of any of the four type actions, which are single, multi, continuous, and semi-continuous.

Secondary Character Stats

Mind: On a scale from 1 to 6, 6 being the highest, mind is the stat that represents a character's will and resistance to being influenced to do or feel something. Psychomancers focus on attacks aimed at the mind. A strong mind will be a higher number, while a weak and easily influenced mind will be a lower number.

Body: On a scale from 1 to 6, 6 being the highest, body is the stat that represents a character's health and resistance to disease and stress caused by certain attacks. Most of the necromancer's diseases and a few of his disciplinary cards require a high body stat to resist. To survive these basic attacks requires a high body stat.

Power: On a scale from 1 to 6, 6 being the highest, power is the stat that represents a character's strength and ability to break holds or basic attacks that are applied for a prolonged time. A character with a higher power stat would be more likely to break a hold than a character with a lower power stat.

Attack Level: This number represents an ally's fighting ability. When an ally attacks a character, this is the number to make or beat when rolling a reverse. Allies do not attack with cards like the gladiators. Instead, their attack is printed on their card.

Example: If an ally with an attack level of 3 attacks Ironsides the cyborg, Ironsides would have to roll 3 or higher to reverse. If he rolled less than 3, then the attack would be successful.

Reversal Rolls: This is the number of reversal rolls an ally can make. (see Rules of The Reversal Rolls in 3.3)

Life and the Damage Wheel (FIG. 1, 19*f*)

To help keep track of your secondary characters (Allies, Undead, Illusions, etc.) Life, we've included a mini form of the counter card right on their card. Using the Damage wheel is extremely easy and saves on the number of counters needed, which is always a good thing.

Your secondary characters total life is the highest number on the damage wheel colored red. When you secondary character takes damage place a counter on the wheel starting from the number 1 representing one damage and moving around the wheel moving up numbers when he takes damage and down numbers when he heals damage. If your secondary character takes damage equal to his life, he is destroyed and the card is retired. You may also show the damage by turning the wheel so that the correct number is facing upward. In this way, no counters are even necessary.

If your secondary character has one life and takes one or more damage than there is no need to use counters. Simply retire the card. The same holds true for secondary characters with 2 life that take 2 or more damage and so on. Also, if a secondary character heals to full life you may remove the counter from the card, since it is no longer needed.

Example 1: An ally has 2 life and takes 1 damage. You would place a counter on the card on number 1 of the Damage wheel. He is damaged again, this time for two damage. Since the 2 damage alone would have been enough to destroy him, the ally is retired and the counters removed for later use.

Example 2: An ally has three life and takes three damage. Since the three damage is enough to destroy him, the ally is retired.

Example 3: An ally has four life and takes two damage. You would place a counter on the card on number two of the Damage wheel. He then heals one damage. You would then move the counter back one on the damage wheel to the number one. He is damaged again for two damage. You would then move the counter up two numbers on the damage wheel to the number three.

Attacking a Secondary Character

You can attack a secondary character in the same way you would attack a gladiator, however the flow is lost regardless of the outcome of the attack. If a gladiator spends his time attacking a secondary character, he would be distracted leaving his opponent the perfect opportunity to strike.

In order to attack a secondary character, look at the reversal roll stat on its card to see the number of reversal rolls it gets. Note that a gladiator cannot use reversal modifiers to effect his secondary character's rolls. But if a gladiator is directly attacking or defending against a secondary character, he may use reversal modifiers as usual. Stun also affects secondary characters.

If a secondary character is successfully attacked, all stun, damage, and other effects of the attack are, if applicable, applied against the secondary character, never against it's owner.

Attacking with a Secondary Character

If a gladiator commands a secondary character (with an ability to attack) to attack, it counts as a free action.

When a secondary character attacks, the effect of the attack (including damage if any), the number of reversal rolls, and any other information relevant to the attack are listed on its card. Remember to use the secondary character's attack level as the number to beat when rolling the first defend roll.

Just think of the secondary character as a second gladiator and remember to use his stats whenever he is affected and not the stats of your gladiator.

4.4 Influence

A Gladiator's popularity is measured with influence. A Gladiator with a high influence is given special favors, like allies to aid him in his duel. Each Gladiator has a base influence represented by the INF rating on his card. If a card he wishes to play has an influence cost, that cost is deducted from the Gladiator's INF as long as it is in the arena.

4.5 Allies

In almost every case, a gladiator cannot last for long if he is outnumbered. It always helps to have an ally on your side to watch your back. Allies require INF to keep in play. Allies give aid to the gladiator but are limited in their use, and most choose not to be involved in direct duels against other gladiators. An ally can only be commanded to do what it's card states as it's ability.

Calling out an Ally: Calling out an ally or a group of allies is a non-attacking action that usually requires INF. Using an ally's ability is a free action.

Example: Mr. Mystery has 4 INF. He calls out 3 Demon Imps (as a non-attacking action). Each of the imps are worth 1 INF for a total of 3 INF. He now has 1 INF free. He wants to call out Brain Beast, but that requires 2 INF. Mystery will have to wait until one of his Imps is destroyed, freeing the second INF he needs to call out Brain Beast.

4.6 Character Classes

Each class is unique and requires different skills to play. If you have a class that you want to use, read its section first, then read the others so you get an idea of your competition. Remember, you can only play one class at a time, so don't feel you have to learn everything about each class before you can play a game. Each player gets to choose one gladiator and uses that gladiator's abilities and stats printed on the gladiator card (see 4.1 Gladiator Cards).

4.6.1 Psychomancer

A psychomancer's major area of concentration is the mind. He is capable of forcing his will on others, directing their actions or making them believe that certain things are happening when in reality they're not.

Mind Rolls: Some psychomantic disciplines require a mind roll as they're being performed. To make a mind roll, both the psychomancer and his target roll a die. The one with the higher mind adds the difference to his roll. If the psychomancer performing the discipline has a higher roll total, the discipline is performed successfully. If there is a tie or the target wins the roll, the discipline fails and is left on the recovery pile.

Example: Madame Petice wants to perform a discipline against Lothar. Lothar's mind stat is 6 and Petice's mind stat is 8. This means that Petice gets a +2 (the difference between both mind stats) to her mind roll. Both gladiators must roll. Lothar Rolls a 4. Petice rolls a 3 and with the +2 bonus, her altered roll is a 5. She beats Lothar's mind roll and as a result, succeeds in performing her discipline.

Pinwheel: Some cards have a (FIG. 1, 4*f*) or a (FIG. 1, 4*g*) in the top right-hand corner. This means that the card has a limited number of uses (its effect can be used a limited number of times).

Pinwheels stay in play until they are used up or they are de-maintained. Each time you use a pinwheel turn it 90 degrees clockwise. Once a pinwheel makes a complete circle, it is used up. There are two types of pinwheels.

Regular Pinwheel: (FIG. 1, 4*f*) The effect is used only one at a time. Each use counts as one action. Every time the card's effect is used you subtract one use by turning the card clockwise 90 degrees so that the pinwheel has one less use.

Combo Pinwheel: (FIG. 1, 4*g*) The effect may be used one or more uses as one action. No matter how many uses you choose to use at a time, the uses still count as one action. You may use any number of uses together as long as the card has that many uses available. Whatever total number of uses you used during that single action, turn the pinwheel clockwise 90 degrees that many times.

Example: You are trying to block 2 damage from an attack with a pinwheel card with two uses remaining that reads "block 1 damage" on it. If the card is a regular pinwheel, you may only block 1 damage because each block counts as an action. For blocking that 1 damage, turn the pinwheel one time. You have one use left for a later time. If, however, the card is a combo pinwheel, you can block the full 2 damage because the two uses of the card count as one action. For blocking the 2 damage, turn the pinwheel two times. The card must be retired because all its uses are gone.

Class Points (CP): Class points represent the power and capacity of the psychomancer's mental powers. The number of CP a psychomancer has affects the number of disciplines he can maintain at any given time and the relative power of the disciplines he can use.

Costs of a Discipline: A psychomantic disciplinary card is identified by the symbol in the upper-left hand corner (see FIG. 1, FIG. 21*a*). In that symbol you will find a performance cost (FIG. 1, 3) and below it you will find a maintenance cost (FIG. 1, 1).

Performance Cost: Performing a discipline means bringing the card into the arena. To perform a discipline, subtract the performance cost listed on the discipline from your current CP. You must have at least the listed cost to perform it. If you fail in bringing the discipline into the arena, you don't get back the performance cost you paid until the maintenance section of the breather phase.

Maintenance Cost: In order to keep a discipline in play, you must pay its maintenance during the maintenance section of the breather phase. This would reduce your available CP by the sum of the maintenance cost of every discipline you are maintaining.

Example 1: A certain illusion requires 2CP to maintain. If a psychomancer with 6CP successfully performs this illusion and decides to maintain it, he or she starts the next combat cycle with 4CP.

Example 2: If a psychomancer with 6CP is maintaining two illusions and a mind alter. One illusion costs 1CP to maintain the other illusion and the mind alter each cost 2CP to maintain. Together, the maintenance costs add up to 5CP leaving the psychomancer with 1CP.

De-Maintaining a Discipline/Retrieving CPs: You may de-maintain a discipline as a free action or during the maintenance section of the breather phase. When you demaintain a discipline, retire it, and give yourself back the CP that were held for its maintenance. CPs are only retrieved when the discipline in question is purposefully de-maintained. If the discipline is used up, destroyed, retired by another player or removed from the arena in any other way, the class points used to maintain it are not returned until the maintenance section of the next breather phase.

Effect Cost: Some disciplines (usually those that are maintained) require some CP or other cost to cause an effect. These disciplines would come to the arena and wait to be used properly at the right time. To perform the effect that requires a cost, simply subtract the number (written in the text before the effect) from your gladiator's class points and pay any other listed costs. CP used in the effect cost returns normally, like the performance cost, at the end of a combat phase.

X Costs (variable costs): Some cards may be a special cost represented by an X. X is a variable to represent CP. This X variable cost will be explained later on the card and usually allows the player some control over how much CP he spends. The X variable is used in mathematics to represent the unknown and functions the same way here. Simply substitute a number for X and replace each X with that number to find out the cost.

Example: A discipline with the text "2XCP: Draw X cards" requires 2 class points to use the effect of drawing one card. For every 2 CP the character of a class A spends, he gets to draw 1 card. If he spends 4CP, he draws 2 cards.

Performing A Psychomantic Discipline: Performing a psychomantic discipline requires placing the card on the recovery pile and the expenditure of CP equal to its performance cost. Performing a psychomantic discipline is a non-attacking action. Successful psychomantic disciplines are placed in either the threat or action fields of the arena, or if they are quickies, retired after use. Using a psychomantic discipline once in the arena is normally a free action. Failed psychomantic discipline cards are left in the recovery pile.

The Four Psychomantic Disciplines

Mind Alter: When a psychomancer tries to change the thoughts of a gladiator or secondary character, he is performing a mind alter. Mind alter includes effects that weaken a gladiator's abilities and reason. A mind alter is performed by a psychomancer against an opponent with a mind stat above 0. A mind roll is normally required between the target(s) and the psychomancer performing the mind alter.

Example: Madame Petice wants to perform a Psychomantic Dagger against Lothar. She has 6CP unused. She spends 1CP (its performance cost) and puts the Psychomantic Dagger card on the recovery pile. Petice beats Lothar's mind roll and as a result, succeeds in performing her Psychomantic Dagger.

Self Control: When a psychomancer focuses his energies inward and tries to raise his abilities or affect his body, he is performing a self control. A self control is normally performed by a psychomancer on himself.

Example: Madame Petice wants to perform a Mind Rush. She spends 5CP (its performance cost) and successfully performs the discipline.

Read Mind: A read mind is an attempt to enter an opponent's mind and reveal hidden information without changing anything. A read mind is performed by a psychomancer against an opponent with a mind stat above 0. A mind roll is normally required between the target(s) and the psychomancer performing the read mind.

Example: Madame Petice wants to perform a Peek against Lothar. She spends 1 CP and places the card on her recovery pile. Lothar rolls a 10. She rolls an 8. With a +2 bonus, her roll is a 10. Since both rolls are the same, Petice fails in performing the discipline. Since the discipline failed, she keeps it on the recovery pile.

Illusion: An illusion is an object created solely from the psychomancer's imagination that takes on a life of its own within an opponent's mind. An illusion is performed by a psychomancer against an opponent with a mind stat above 0. A mind roll is normally required between the target(s) and the psychomancer performing the illusion.

An illusion can affect only it's target and can be affected only by it's target. An illusion can be destroyed either by being de-maintained by the psychomancer that was maintaining it or if it's target deals to it damage greater than or equal to it's life. A destroyed illusion does not become a corpse (see Corpses in 4.6.2) and it is retired. The gladiator that maintains an illusion controls it. The gladiator that controls an illusion may use its ability as a free action.

Example: Last combat cycle, Madame Petice successfully performed a Sabretooth illusion on Lothar. Lothar wants to destroy it so he performs a second level attack against the Sabretooth. He is successful and the Sabretooth takes 2 DMG, enough to destroy it. That illusion card is retired and it's maintenance points are not returned to Petice until the breather phase.

4.6.2 Necromancer

The necromancer is a gladiator that relies on his abilities that deal with the awesome power of the underworld.

Body Rolls: Some necromantic disciplines require a body roll as they're being performed. To perform a body roll, both the necromancer and his target roll a die. The one with the higher body adds the difference to his roll. If the necromancer performing the discipline has a higher roll total, the discipline is performed successfully. If there is a tie or the target wins the roll, the discipline fails and is left on the recovery pile.

Example: Lothar wants to perform a raise dead discipline against Mr. Mystery, which requires a body roll. Lothar's body stat is 7 and Mystery's body stat is 4. This means that Lothar gets a +3 (the difference between both body stats) to his body roll. Both gladiators must roll. Lothar Rolls a 4 and with the +3 bonus, his altered roll is a 7. Mystery rolls a 5. Lothar beats Mystery's body roll and as a result, succeeds in performing his discipline.

Corpses: After an ally or gladiator is destroyed, it becomes a corpse. Corpses are the life-blood of the necromancer; he can use them to create undead armies, spread disease, and pump up his undead with enhanced powers. When an ally or gladiator dies, flip it face-down to represent a corpse. Once a corpse is used, the card is retired and goes into the owner's retired pile. Destroyed undead and illusions do not become corpses and are retired. Most undead and reshape dead use a corpse during creation. Corpses are available to any necromancer who wants to use them.

Pumps: A pump is a card that attaches itself to another card to effect it. A pump is retired when the card it is attached to is retired in addition to any other normal ways of retiring the card. (See Reshape Dead in 4.6.2.)

Class Points: Class points represent the power and capacity of the necromancer's powers. The number of CP a necromancer has affects the number of disciplines he can maintain at any given time and the relative power of the disciplines he can use.

Costs of A Discipline

A necromantic disciplinary card is identified by the symbol in the upper-left hand corner (FIG. 1, 21*b*). In that symbol you will find a performance cost (FIG. 1, 3) and below it a maintenance cost (FIG. 1, 1).

Performance Cost: Performing a discipline means bringing the card into the arena. To perform a discipline, subtract the performance cost listed on the discipline from your current CP. You must have at least the listed cost to perform it. If you fail in bringing the discipline into the arena, you don't get back the performance cost you paid until the end of the breather.

Maintenance Cost: In order to keep a discipline in play, you must pay its maintenance cost during the maintenance section of the breather phase. This would reduce your available CP by the sum of the maintenance cost of every discipline you are maintaining.

Example 1: A disease requires 2CP to maintain it. If a necromancer with 6CP successfully performs this disease and decides to maintain it, he starts the next combat cycle with 4CP.

Example 2: A necromancer with 6CP is maintaining a disease an two undead. One undead has a maintenance cost of 2CP. The other undead and the disease each have a maintenance cost of 1CP so together they need 4CP to maintain. The necromancer will have 2CP left since 4CP are being used to maintain the three disciplines.

De-Maintaining A Discipline/Retrieving CPs

You may de-maintain a discipline anytime as a free action or during the maintenance section of the breather phase. When you de-maintain a discipline, retire it, and give yourself back the CP that were held for its maintenance. CPs are only retrieved when the discipline in question is purposefully de-maintained. If the discipline is used up, destroyed, retired by another player or removed from the arena in any other way, the class points used to maintain it are not returned until the next maintenance section of the breather phase.

Effect Cost: Some disciplines (usually those that are maintained) require some CP or other cost to cause an effect. These disciplines would come to the arena and wait to be used properly at the right time.

To perform the effect that requires a cost, simply subtract the number (written in the text before the effect) from your gladiator's class points and pay any other listed costs. CP used in the effect cost returns normally, like the performance cost, at the end of a combat phase.

Example 1: The text on a necromantic discipline card says "When an ally is destroyed, 2CP, retire a corpse: Deal 1 DMG to all gladiators". That means if a necromancer pays 2CP and retires a corpse after an ally is destroyed, all gladiators take 1 DMG.

X Costs (variable costs): Some cards may have a special cost represented by an X. X is a variable to represent CP. This X variable cost will be explained later on the card and usually allows the player some control over how much CP he spends. The X variable is used in mathematics to represent the unknown and functions the same way here. Simply substitute a number for X and replace each X with that number to find out the cost.

Example 1: A discipline with the text "2XCP: Draw X cards" requires 2 class points to use the effect of drawing one card. For every 2 CP the character of class A spends, he gets to draw 1 card. If he spends 4 CP, he draws 2 cards.

Performing Necromantic Disciplines

Performing a discipline normally requires placing the card on the recovery pile and paying its performance cost. Performing a discipline is normally a non-attacking action. Successful necromantic disciplines are placed in either the threat or action fields of the arena, or if they are quickies, retired after use. Using a discipline once in the arena is normally a free action. Failed discipline cards are left in the recovery pile.

The Four Necromantic Disciplines

Raise Dead: With this ability, a necromancer can reanimate a creature's corpse and create an ally for himself. The raised dead become undead, loyal servants ready to aid their creator. When undead are destroyed, they do not become corpses and are retired.

A raise dead becomes an undead after it is performed. Performing a raise dead normally requires retiring a corpse. An undead can be destroyed either by being de-maintained by the necromancer that was maintaining it or if it takes damage greater than or equal to its life. A destroyed undead is retired and does not become a corpse (see Corpses in 4.6.2). The necromancer that maintains an undead controls it. The necromancer that controls an undead may use its ability as a free action.

Example: A Demon Imp was destroyed and turned into a corpse. Lothar uses 3 CP and places a Bone Beast card on his recovery pile. He retires the corpse (this card now goes into it's owner's retired pile. Now, Lothar puts Bone Beast into the threat field.

Reshape Dead: A necromancer can turn a corpse into something useful like armor or wings and pump an undead with it. The pumped undead will be better than before.

A reshape dead is normally used by a necromancer against an undead. Performing a reshape dead requires retiring a corpse. A reshape dead can normally be destroyed either by de-maintaining it or destroying the undead it pumps. A destroyed reshape dead does not become a corpse and it is retired. The necromancer that maintains a reshape dead controls it.

Example 1: Lothar's Bone Beast just destroyed a Troll Warrior. Lothar spends 2CP and puts a Jagged Bones card (raise dead discipline) on his Skeletal Guard. Now his Skeletal Guard does an additional DMG in combat along with the other benefits that the Jagged Bones provides.

Example 2: Ironsides then attacks Lothar's Bone Beast and destroys it. The Bone Beast, along with the Jagged Bones, goes into Lothar's retired pile—neither it nor the Jagged Bones attached to it become a corpse. Lothar does not get back his maintenance points until the breather phase.

Séance: A séance is a cry to the underworld to make something supernatural happen. Some undead are created with a seance (this brings an advantage because seances usually do not retire corpses). Some seances can also be used to control or affect another necromancer's undead.

Disease: The necromancer's association with death makes disease kin to his abilities. With disease, the necromancer can make his opponent sick and weak, preventing the afflicted from properly using its abilities. Most diseases use a body roll between the target(s) and the necromancer performing the disease.

4.6.3 Cyborg

Any being with electromechanical implants and enhancements is a cyborg. This gladiator makes the best combat intensive opponent one can face. From synthetic muscles to wired reflexes, the cyborg is literally a fighting machine.

Power Rolls: Some cyborg disciplines require a power roll as they're being performed. To make a power roll, both the cyborg and his target each roll a die. The one with the higher power adds the difference to his roll. If the cyborg performing the discipline has a higher roll total, the discipline is performed successfully. If there is a tie or the target wins the roll, the discipline fails and is left on the recovery pile.

Cyborg Memory: Cyborg memory is the capacity of programs a cyborg can keep in the arena at a time. Each program could have a capacity as low as 1 and some could have more. The sum of all program sizes must be less than a cyborg's memory.

Costs Of A Discipline: A cyborg disciplinary card is identified by the symbol in the upper-left hand corner (see FIG. 1, 21*c*). In that symbol you will find a performance cost (see FIG. 1, 3) and a maintenance cost (see FIG. 1, 1).

Performing Cyborg Disciplines: Performing a discipline normally requires placing the card on the recovery pile and paying its performance cost. Performing a discipline is normally a non-attacking action. Successful cyborg disciplines are placed in either the threat or action fields of the arena, or if they are quickies, retired after use. Using a discipline once in the arena is normally a free action. Failed discipline cards are left in the recovery pile.

The Three Cyborg Disciplines

Augmentations (Aug): An aug is an implant or attachment that replaces or reinforces various body parts. The augs are either faster, stronger—basically better—than before. A cyborg is limited in the number of augs of a type he can bring into the arena. For example, a cyborg may have only one leg aug and two arm augs. Using an aug requires paying a run cost.

Programs: The mind can process only so much information at a time. Hook up a computer in the brain and add some programs and you have enhanced abilities.

A program takes up space on the cyborg's memory. Using a program requires paying the run value and counts as a free action. Programs might require points to be maintained or performed. Some can be maintained so using it costs less.

Body Modifications (Bod-Mods): A bod-mod is an implant that is in constant use and does not require points to use. A bod-mod's effects are constantly in use or are automatically used when a condition is met. Normally, every bod mod has a life. Once a bod-mod's life is 0, it is retired. Bod mods are maintained with CP. Bod-mods, like augs, are limited in number and type. For example, a cyborg may only have two hand mods and one chest mod.

4.7 Reversal Modifiers

During a duel, gladiators might perform an impressive reversal that can give him the edge over his opponent.

Reversal modifiers can be used by any class and have a performance cost in the top left corner. The cost is in class points. The class points used to bring a reversal modifier into the arena are not returned until the breather phase.

A reversal modifier is an alternative to the standard reversal roll. Instead of taking the 1 to 10 on one die, a player might take two dice and add them, or roll an automatic 8. Reversal modifiers can give you the edge you need to perform your attack against an opponent.

A player would use a reversal modifier card at the right time (stated on the card) when the reversal rolls are made for attacks. There are reversal modifiers that affect attackers and defenders, or if a card simply says reversal roll, it can be used by either the attacker or defender.

Example 1: Lothar attacks Ironsides. Ironsides, rolls a 5. Lothar uses a reversal modifier which allows him to roll two dice. He rolls a 3 and a 4. Together, they are 7 and Lothar's attack is successful.

Reversal modifiers use up class points however, but usually, the cost is worth it.

Example 2: Mister Mystery attacks Madame Petice. She rolls a 2. He uses a reversal modifier for 1CP and makes his roll a 4. She rolls her second roll and it is a 1, however, Petice uses 2CP and uses a reversal modifier to re-roll her roll, resulting in a 6. Mystery rolls his last roll and he gets a 7. Petice spends another 2CP to make him re-roll his roll. He rolls a 5 and Petice reverses the attack.

4.8 Warnings

Warnings have four major uses within the invention, but regardless of how you receive them, if you get three you lose the match. The three main ways to receive warnings are:

1) The First Hand Re-draw: If you choose to use the first hand re-draw option you will receive one warning for each time you use it up to a maximum of two times, since three warnings loses the match.

2) Player's Option: The one gray area in all card games is when a player performs an action at an improper time or forgets to perform an action and wants the other player to agree to allow it. Most games don't give any help in this area to the player, but the invention has the warning rule built in to help players resolve these disputes with fairness.

a) If a player performs an action at an improper time, his opponent may at his discretion make him take a warning or warnings for the action or make him take it back.

b) If a player forgot to perform an action, his opponent may at his discretion make him take a warning or warnings for doing the action after the fact.

c) When deciding on the number of warnings given, players should make fair judgments based on the importance of the action to the game, the level of skill of the opponent, and the leniency given by the opponent in similar situations.

d) Players may give warnings; that if accepted; would disqualify their opponent.

e) In the event of a dispute, a fair third party should be selected and their decision should be final.

3) Banned Cards: In the future, the powers that be at the invention may decide to outlaw certain characters, attacks, disciplines, etc. from their arenas. Any players found using these in a match will be subject to the warning penalties that the board of the invention deems appropriate.

4) Extending a Game: Players might ask for additional life blocks to make a game last longer. If all players agree, the one who asked for a life extension would get one or more warnings.

4.9 Deck Allowance

Every card has a deck allowance that states how many copies of a card may be used in a game. There are six deck allowance classifications.

Unique: A unique card can only be used once per game by only one player. Whoever uses the card first, uses it as normal. After that, every player discards his copy of that used unique card the moment it is in his hand.

Precious: A player can only have one copy of a precious card.

Rare: A player can only have up to two copies of a rare card.

Uncommon: A player can only have up to three copies of this card.

Common: A player can only have up to 4 copies of this card.

Ordinary: A player can only have up to 5, 6, 7, or 8 copies of this card. The actual number will be stated on the card itself.

4.10 Big Game

So, you think you have learned all there is to learn. Do you think you are ready to become one of the great champions of the invention? Very well then, it is time that you started on your journey. You now know enough to play a fall game of the invention.

Now that you're ready, find an opponent. Fight real opponents will be the only way you will gain the fighting experience you will need to survive and maybe even succeed.

Part 5:—Glossary

Altered roll—a modified natural roll.

Arena—this is the play area or table surface where the cards that are not in the hand stay.

Attack—any action that damages or effects a character; an action made by a player against another player. A player making an attack is called an attacker. The target of an attacker is called a defender.

Attack roll—a reversal roll used to determine the outcome of an attack.

Banned cards—cards that cost warnings to bring into play.

Block—stops an attack, but lets the attacker keep the flow.

Body—the stat that determines your resistance to physical injury.

Call out—the action that brings an ally into the arena.

Character—gladiator and secondary characters (see 1.5 Categories for Characters).

Class—a category which a gladiator falls under; each class has different abilities.

Class points—used for performing disciplines and reversal modifiers.

Control—to be able to use a cards abilities.

Corpse—the remains of a destroyed creature; an ingredient for necromantic disciplines.

Counter cards—a neat way of keeping track of fluctuating numbers like life or class points.

Counters—any device used to measure fluctuations in numbers.

Deals—directly happens without a roll.

Deck allowance—the number of copies of a certain card allowed in a deck.

Defend roll—a reversal roll used to stop an attack and steal the flow from the attacker.

Destroy—to reduce a character's or object's life to less than 1.

Discard—to remove from your hand and place on the recovery pile.

Disciplinary card—a single card within a discipline.

Discipline—a characteristic of cards within a class; for example, read mind.

Disqualify—(DQ) to lose the game as a result of taking too many warnings.

Draw—take a card from your repertoire and place it in your hand.

End of combat cycle—when all players have passed in succession.

Field—the arena is divided into fields. includes threat and action fields.

Flow—control of the game.

Free action—any action that does not result in the loss of the flow.

Gladiator—the main character that is controlled by a player.

Hand—the cards you can play; you hold them in your hand.

Illusions—a non-player character and a psychomantic discipline that exists in the mind of a character; only that affected character may affect the illusion.

Influence—points used to bring some types of cards into the arena.

Life bonus—added or subtracted from a gladiator's life at the beginning of a duel.

MBAL—max basic attack level.

MDL—max discipline level.

Mind—the stat that determines your resistance to a psychomancer's discipline.

MRR—max reversal rolls.

Natural roll—the number shown on a die after you roll it. A die roll modifier can change the natural roll, if this is the case, the new natural roll is the result of the modification.

Owner—the player who owns a card regardless of who controls it.

Perform—to attempt to bring a card into the arena.

Physical attack—is an attack like a punch or a kick which requires contact between the attacker and the defender.

PL stack—all successful attack cards of a certain level that add to PL are kept in a stack to the right of the gladiator card.

Player—a person playing the game that controls the cards and a gladiator; a person who controls a character in the game. The actions done against (or by) a player are actually done against (or by) the gladiator he represents.

Player's option—rules that help players resolve conflict through use of the warning system.

Power—the stat that represents a gladiators ability to escape holds.

Power level (PL)—a varying number which allows certain cards and abilities to be performed by a gladiator.

Power up—to raise power levels.

Pump—a type of card that attaches itself to another card.

Quickie—a type of card that is retired after it is used.

Reaction—an action you may use when you don't have the flow—like a reversal roll. A reaction must be triggered by an action.

Recovery—the pile of cards that have been used and will be used again; it is made into the repertoire after the last card from the repertoire is drawn.

Renew the repertoire—converting the recovery pile into a new repertoire pile after the repertoire is empty.

Repertoire—the pile of cards that represent a gladiator's experience, knowledge, and strategy; when you draw, you draw from this pile.

Requires—a cost that must be paid in order for an action to take place.

Retire—remove the card and place it in the retired pile.

Retired pile—holds all retired cards; stays by repertoire; only special effects bring back these cards.

Reverse—stops an attack and allows the defender to get the flow.

Reversal roll—determines the outcome of an attack. The attacker gets an attack roll and the defender gets a defend roll.

Secondary character—any character that is not a gladiator.

Stat—a representation by number of a character trait.

Stun—stun and other temporary effects do not carry over into the next combat cycle.

Target—a character or item an effect is directed toward.

Undead—an ally created from a raise dead or seance discipline that has no mind score.

Unstoppable—the effects of which automatically succeed.

Withdrawing—calling back a creature.

IV. Miscellaneous Remarks

What's the difference between a combat phase and a combat cycle?

A combat phase is part of a combat cycle. Each combat cycle is made up of a combat phase and a breather. (See 2.2 Combat Cycle.)

What if my repertoire runs out of cards?

You take your recovery pile and place it face-down where your repertoire used to be. This is called renewing the repertoire. (See Redraw in 2.2)

How do power levels work?

Most attack cards have a starburst (FIG. 1, FIG. 4*b*) on the top left corner. These starbursts count to increasing your gladiator's power level. Higher PLs allow a gladiator to try more advanced attacks and disciplines and have more reversal rolls.

Why is attacking a secondary character considered a non-attacking action?

Secondary characters might know how to fight, but a gladiator is more experienced. If his opponent attacks a secondary character, the gladiator will take advantage of that opportunity, he won't wait. Remember, since this is a real-time game, certain actions will allow the other player to have control.

Is there a breather phase in real life?

Yes, in any fight, there are always moments when fighters stop and rethink strategies, exchange words, take a rest, give mean looks, and even show off. A boxer might dance to show he is not tired, a kung-fu master might pose his stance, a brawler might growl at his opponent as he takes a rest, and a gladiator might try to figure out which attacks would catch his opponent.

Can I raise my gladiator's MBAL, MRR, or MDL?

No, these numbers are fixed. They represent a gladiator at his best abilities.

General Notes:

The game can be played in different forms such as computer games, video games, electronic games, network games, and other forms such as board games.

The rules can be modified, new rules added, character classes added, etc. Modern Card games come out with new cards and expansions often. This is important to understand in the context of the invention.

Different levels of rarity are contemplated for the cards such that some are easy to obtain while others are limited to different degrees. This is also standard for games for it adds collectability.

Key rules of the game such as The Flow, Power Level, Reverse Rolls, Class points, maintenance points, and warnings add significantly to its excitement and attractiveness. So does the shell of the game. The shell of the game works the same for all the character classes. They all preferably include power-levels, class points, etc. But these rules work differently in different settings. Not only are many cards "class specific", but the way the cards themselves are used, depends on the class: Those described and those to be added. An example would be how psychomancers use illusions, while cyborgs use programs and bod-mods. Illusion cards and bod-mod cards, which are class specific, all require the player to be at a certain power level and require class points, but they work differently. The cyborg class is only included as an (at least partially described) example to further show how new classes may be made, including new rules and play mechanics.

The Real Time nature of the game derives from The Flow and its rules of play. The game is not played with static turns. Instead, by the player's choice of action or success or failure of certain actions determines who goes next. There are no turns. On a basic level, this is what a Real-Time game is. A Real-Time card game also includes variations in Deck Drawings.

Preferably, players can only use (are limited to) cards that their chosen character can use. Each class contains its own cards which can be used only by that class, like a raising dead for necromancers, or programs for cyborgs. There are also universal cards that may be used by all the classes, such as punches. Cards may be brought into play through three major means: Through Influence Points, class points, and through current power level.

The game is not limited to two players but may, through adjustments to the rules, scale to many different player combinations such as two on two, three against all, etc.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of playing a game involving two or more players, the method comprising the steps of:

obtaining a reservoir of game components;

enabling players to draw from the reservoir of game components in accordance with rules of play; and each player executing plays or series of plays, based on a flow control that uses one or more of the elements of chance, strategy, skill, knowledge, and variables to determine which player is to execute the next play or series of plays.

2. The method of claim 1, in which the game components are physical cards.

3. The method of claim 1, including playing the game through a computer medium.

4. The method of claim 1, including providing the game components in a variety of classes, each class representing different game component abilities and functionalities.

5. The method of claim 4, providing different types of game components within a class, each different game component type having a unique discipline representing a characteristic of the components within the class.

6. The method of claim 1, including playing the game as a plurality of cycles.

7. The method of claim 1, including playing the game with a main character component that is controlled by a player.

8. The method of claim 1, including ascribing to the game components points used to bring some types of components into a playing area.

9. The method of claim 7, including permitting players to play the game with different main character components.

10. The method of claim 1, including enabling at least some of the game components to have a game power ability that is based on a varying power level.

11. The method of claim 1, including providing counter cards and using the counter cards for keeping track of fluctuating numbers associated with the game.

12. The method of claim 1, including allowing chance, strategy, variables, skill, or knowledge to determine the results of a play.

13. The method of claim 1, including providing at least some of the game components as more rare than others.

14. The method of claim 12, including using dice to determine results of play.

15. The method of claim 12, including allowing the determiner of the results to be modified.

16. The method of claim 14, including engaging in a reversal roll to determine the outcome of an attack, wherein an attacking player plays an attack roll and a defending player plays a defending roll.

17. The method of claim 1, including playing the game with a reservoir that includes a main character and at least one secondary character.

18. The method of claim 1, including assigning certain actions, point values that, when a predetermined number of them are accumulated, cause a player to be eliminated from the game.

19. The method of claim 18, including players optionally assigning point values for performing certain actions.

20. The method of claim 1, including displaying a status or usability of certain components by moving the component from one designated area to another.

21. The method of claim 1, including charging some game components cost points to remain in play or else be removed.

22. The method of claim 1, including obtaining the reservoir from a pool of available game components.

23. The method of claim 1, including playing the game so that certain plays add towards a needed number of plays to reach other power levels.

* * * * *